US006082814A

United States Patent [19]

Celestina-Krevh et al.

[11] Patent Number: 6,082,814

[45] Date of Patent: Jul. 4, 2000

[54] RECONFIGURABLE CHAIR FOR INFANTS TODDLERS AND SMALL CHILDREN

[75] Inventors: Mary Ann Celestina-Krevh, Euclid, Ohio; Stan Kujawski, East Aurora, N.Y.; Nova Mihalik Buchanan, Hudson, Ohio

[73] Assignee: Graco Children's Products Inc., Elverson, Pa.

[21] Appl. No.: 09/115,295

[22] Filed: Jul. 14, 1998

[51] Int. Cl.[7] ..... A47C 13/00

[52] U.S. Cl. ..... 297/118; 297/93; 297/130; 297/153; 297/344.12

[58] Field of Search ..... 297/1, 3, 118, 297/119, 93, 123, 128, 130, 138, 153, 155, 283.1, 344.12

[56] References Cited

U.S. PATENT DOCUMENTS

| | | | |
|---|---|---|---|
| D. 288,868 | 3/1987 | Saltzman et al. . | |
| 2,505,490 | 4/1950 | Greenbaum . | |
| 3,175,860 | 3/1965 | Tcherniavsky | 297/93 |
| 4,288,123 | 9/1981 | Cone . | |
| 4,582,359 | 4/1986 | Wise et al. . | |
| 4,645,261 | 2/1987 | Bourne et al. | 297/118 |
| 4,722,570 | 2/1988 | Bertoli | 297/153 X |
| 5,413,399 | 5/1995 | Meyers et al. | 297/130 X |
| 5,829,826 | 11/1998 | Ziccardi | 297/344.12 X |

FOREIGN PATENT DOCUMENTS

| | | | |
|---|---|---|---|
| 537871 | 5/1922 | France | 297/130 |
| 880921 | 4/1943 | France | 297/130 |

*Primary Examiner*—Laurie K. Cranmer
*Attorney, Agent, or Firm*—Foley & Lardner

[57] ABSTRACT

A reconfigurable chair for use with infants, toddlers and small children. A chair base has a pair of channel members extending forward and aft of the chair base and providing a seat reference plane for a removable seat having a back and a platform. The seat is provided with first and second laterally extending guides engagable with the channels in the chair base. Several seat position detents are provided in each channel. Additional detents are provided above the reference plane at the rear of the chair base to enable the seat to be installed at an angle when used with an infant. When used with a toddler or a small child, the seat can be arranged in either an upright or an inverted mode. An auxiliary tray can be mounted either in a conventional fashion from the front of the chair base or from either side for infant feeding.

21 Claims, 13 Drawing Sheets

RECONFIGURABLE CHAIR FOR INFANTS TODDLERS AND SMALL CHILDREN

BACKGROUND OF THE INVENTION

This invention relates to household chairs for use with small children. More particularly, this invention relates to a reconfigurable chair capable of accommodating an infant, a toddler and a young child.

Young humans pose different seating requirements, particularly during feeding, which requirements vary with the stage of development. An infant, for example, usually requires a seat providing a reclined attitude during feeding, usually with some type of physical restraint to prevent the infant from squirming out of the seat. A toddler is usually placed in a high chair with the torso in an upright position and a feeding tray is usually removably attached to the high chair in front of the toddler. A young child beyond the toddler stage is normally provided with a booster chair so that the youth may reach the comestibles at an ordinary kitchen or dining room table. In the past, these differing seating requirements have resulted in the use of three separate types of seating devices. For the infant, a currently popular convertible carrier is used, which is typically an integral shell with a padded lining with the shell having a seat and a back arranged at a reclining angle for the infant. For the toddler, a high chair/tray arrangement is used. For the youth, a booster seat arrangement is used, consisting of either a separate booster chair or an accessory for an ordinary chair providing the booster capability. While efforts have been made in the past to devise a single chair capable of providing all three seating arrangements, such efforts have not been entirely successful.

SUMMARY OF THE INVENTION

The invention comprises a reconfigurable chair which affords an infant mode, a toddler mode and a youth mode of seating configuration and which can be readily converted from one mode to another without the need for any special tools and in a convenient and easy fashion.

The reconfigurable chair comprises a chair base, a removable seat and a mounting arrangement for enabling the seat to be configured in a reclined position for the infant mode, in an upright position for the toddler mode with the seat back upright, and in an inverted position for the youth mode in which the scat back extends generally downwardly of the chair base.

The mounting mechanism preferably includes a pair of channels extending between the front and the back of the chair base, and a set of guide members mounted on the seat and extending generally laterally outwardly therefrom, the guide members being arranged for slidable engagement with the channels. Preferably, the channels are provided with one or more detent positions in which the guide members are releasably retained to provide a stable position for the seat.

A pair of additional detents are provided on the chair base at a level above the channels and preferably at the back in order to provide a positive stop for some of the seat guide members when the seat is arranged in the infant mode.

To enhance the effectiveness of the chair in the infant mode, a tray mounting mechanism is included for enabling a tray to be releasably mounted on either side of the chair base at a suitable level for helping an adult feed the infant or placement of other articles typically used to care for an infant. The tray mounting mechanism preferably comprises a channel formed on the back of the chair base and a second channel formed on the back of the removable seat so that edge mounting surfaces of the tray can be inserted into the channels and adjusted inwardly and outwardly to the preferred position. An additional tray mounting means is also provided to enable the tray to be mounted either left or right of the chair base.

To adjust the seat to the infant mode, a pair of outwardly extending guide members located near the junction between the seat back and seat platform are inserted into the chair base channels, and the seat is canted to the approximate desired position. The seat is then manipulated inwardly of the chair base until a second pair of outwardly extending guide members located near the free end of the seat platform engage the detents formed in the chair base above the channels and at the rear.

To arrange the seat in the toddler mode, the seat guide members adjacent the junction between the seat back and platform are first inserted into the chair base channels from the front of the chair base, and the seat is manipulated inwardly until the other pair of guide members are received in the same pair of channels in the chair base. The forward and aft position of the seat is then adjusted until the desired detent position is achieved.

To configure the chair in the youth mode, the seat is installed from the rear of the chair base with the seat back pointing downwardly, the front seat guide members are inserted into the channels and the seat is manipulated inwardly of the chair base.

The invention provides a single chair which is easily reconfigurable among the three different modes, without the need for any special tools or mechanical expertise. The chair thus grows with the child and avoids the need to purchase different chairs at different stages of child development.

For a fuller understanding of the nature and advantages of the invention, reference should be had to the ensuing detailed description taken in conjunction with the accompanying drawings.

DETAILED DESCRIPTION OF THE PREFERRED EMBODIMENT

Figure 1:
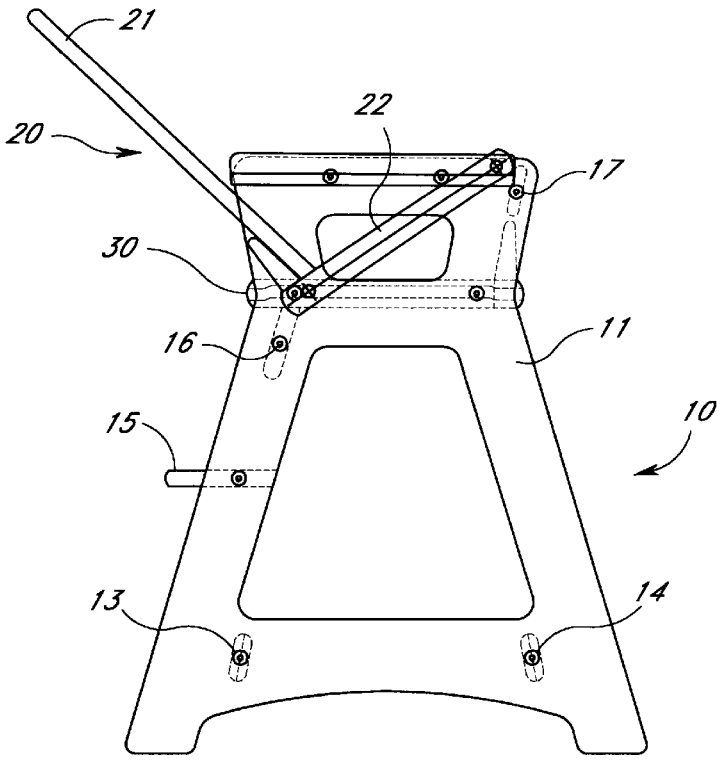
FIG. 1 is a side elevational view of the invention in the infant mode.
Figure 2:
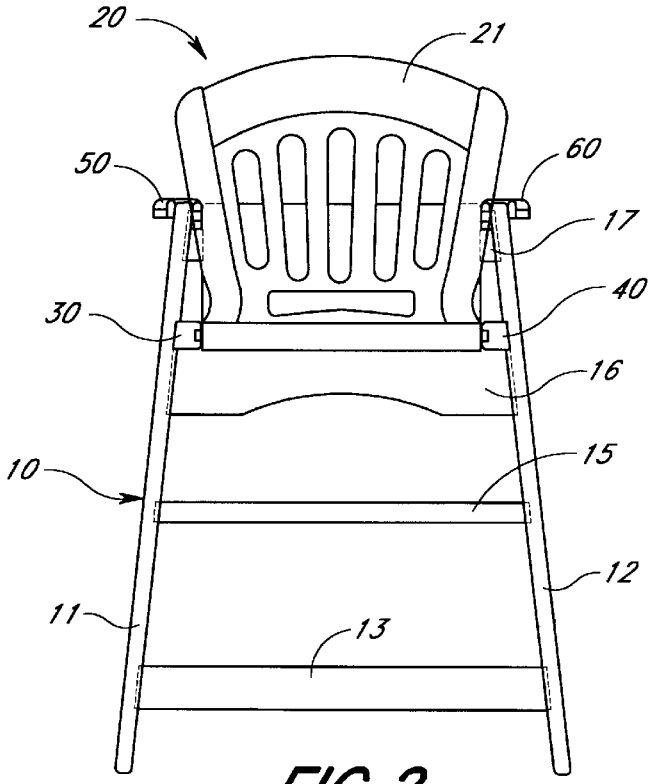
FIG. 2 is a front elevational view of the invention in the infant mode.

Turning now to the drawings, FIGS. 1 and 2 are side and front elevational views, respectively, of the preferred embodiment of the invention configured in the infant mode. As seen in these figures, the invention includes a chair base generally designated with reference numeral 10 and a removable chair seat generally designated with reference numeral 20. Chair base 10 includes the pair of opposing sides 11, 12 joined together by a plurality of cross members 13–17. Preferably, elements 11–17 are fabricated from wood and cross members 13–17 and side members 11, 12 are secured together using suitable threaded fasteners, such as wood screws. Cross member 15 serves as a foot support when the chair is used in the toddler and youth mode. Cross member 17 serves as a back support when the chair is used in the youth mode.

Figure 7:
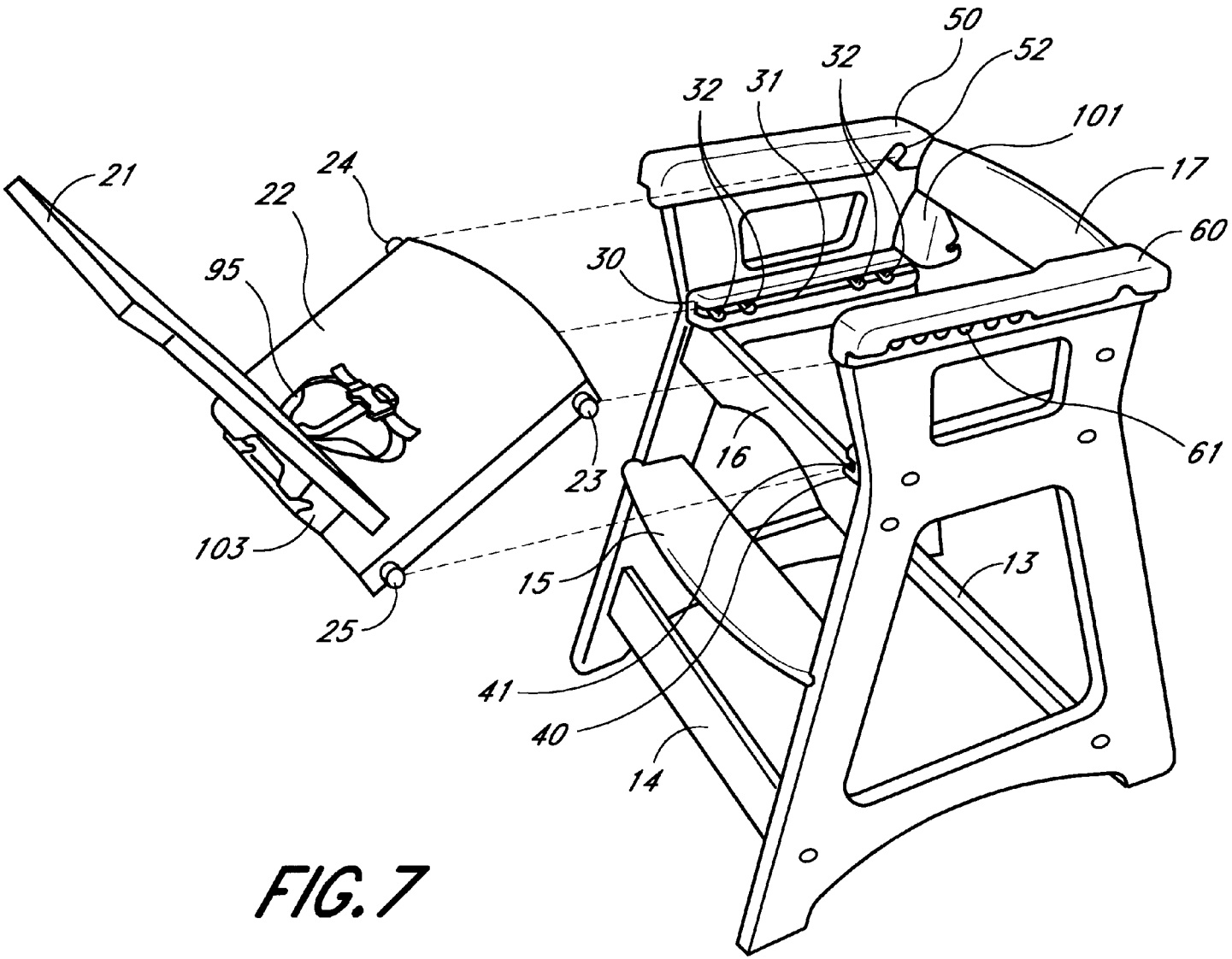
FIG. 7 is a perspective view showing the chair base and seat prior to installation for the infant mode.
Figure 8:
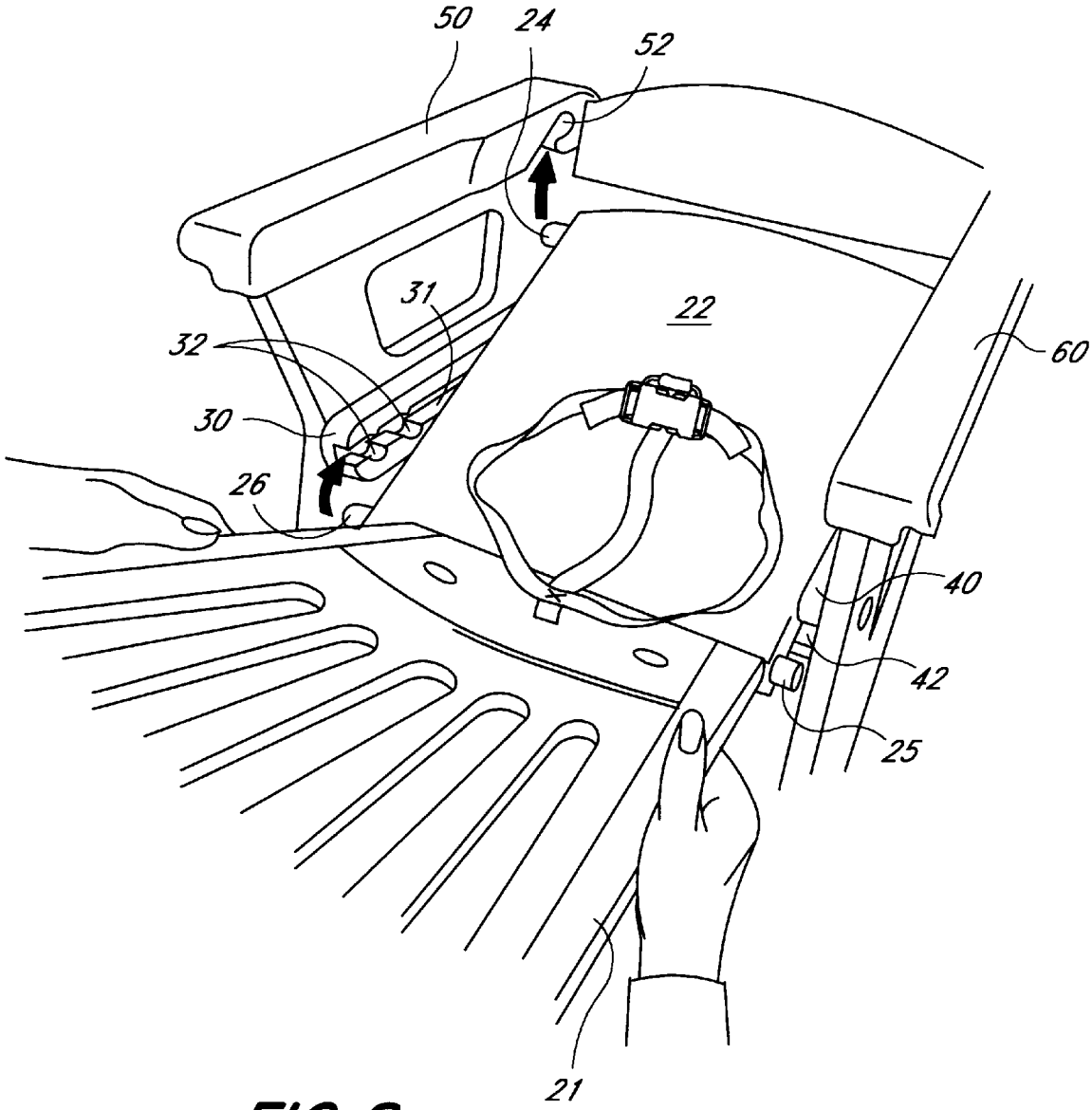
FIG. 8 is an enlarged perspective partial view illustrating insertion of the seat guide members into the chair base channels for the infant mode.

Secured to the inner side edges of opposing side members 11, 12 and extending forward and aft of chair base 10 are a pair of guide channel members 30, 40. As illustrated in FIG. 7 for guide channel member 30, each guide channel member 30, 40 is provided with a longitudinal channel 31, 41 having a plurality of detent grooves 32, 42 formed therein. The purpose of detent grooves 32, 42 is to provide a plurality of detent positions for the seat 20 in the manner described below.

Figure 11:
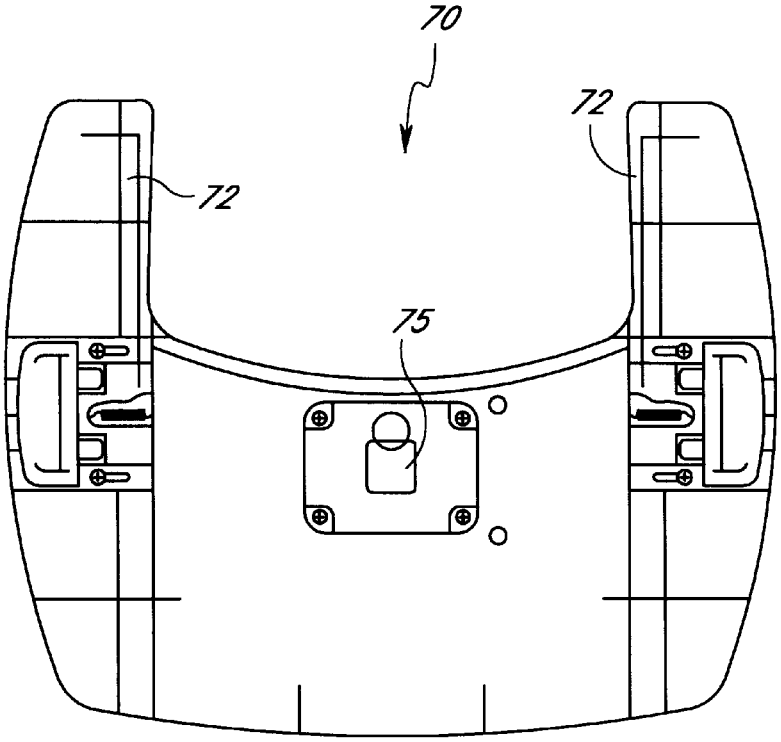
FIG. 11 is a bottom plan view of the removable tray.
Figure 15:
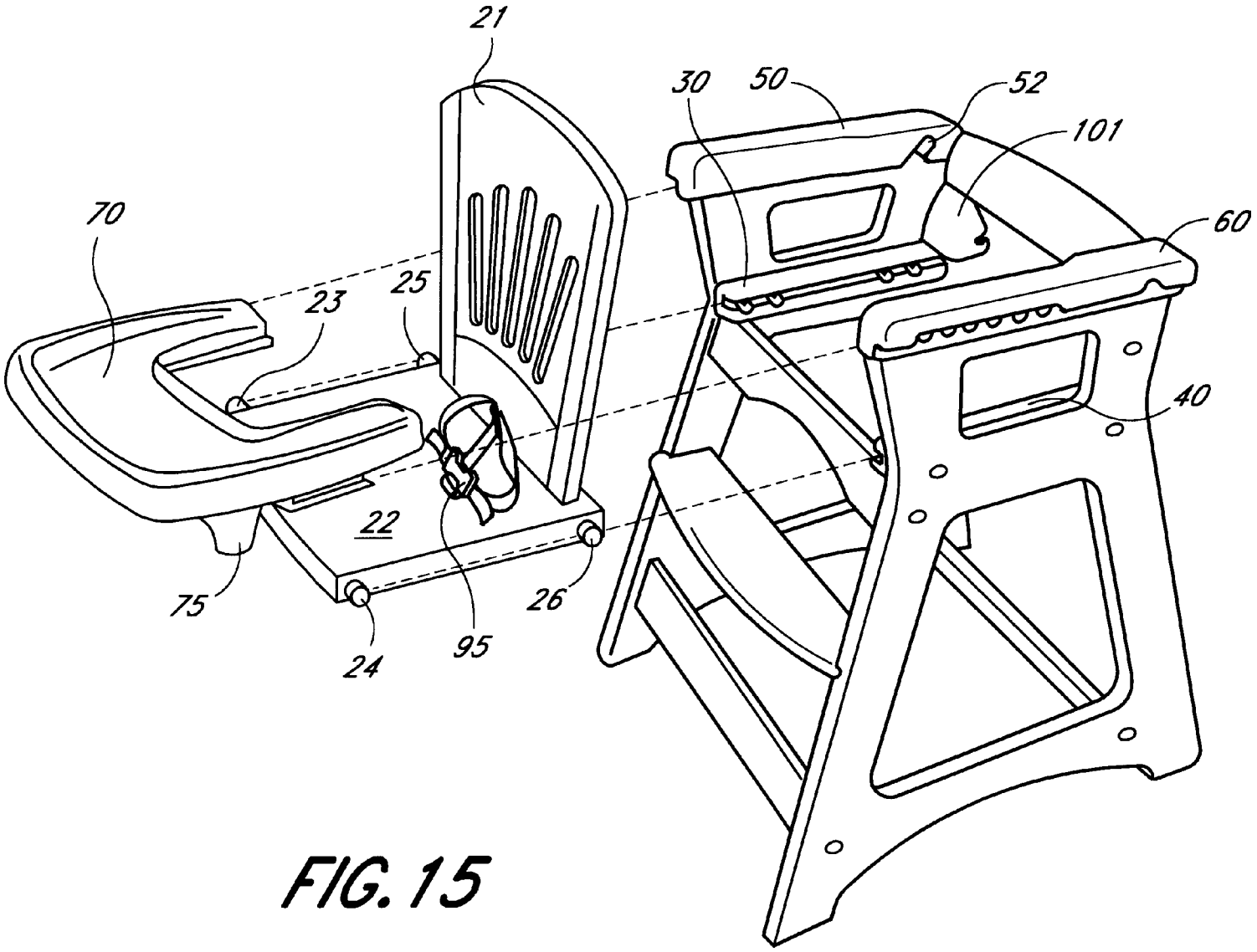
FIG. 15 is an exploded perspective view of the invention in the toddler mode with tray.
Figure 16:
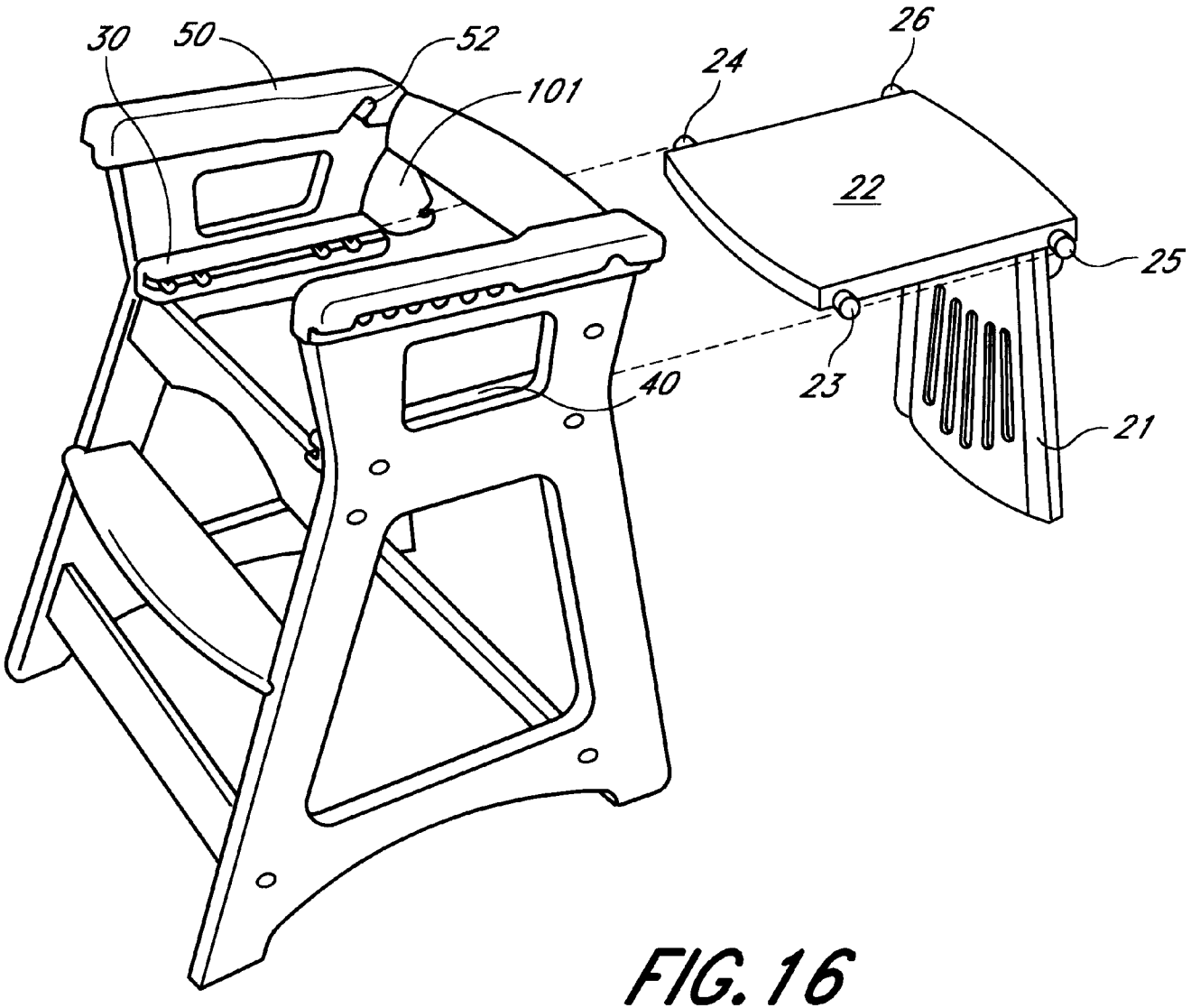
FIG. 16 is a perspective view illustrating the seat back in the inverted position prior to installation in the youth mode.
Figure 17:
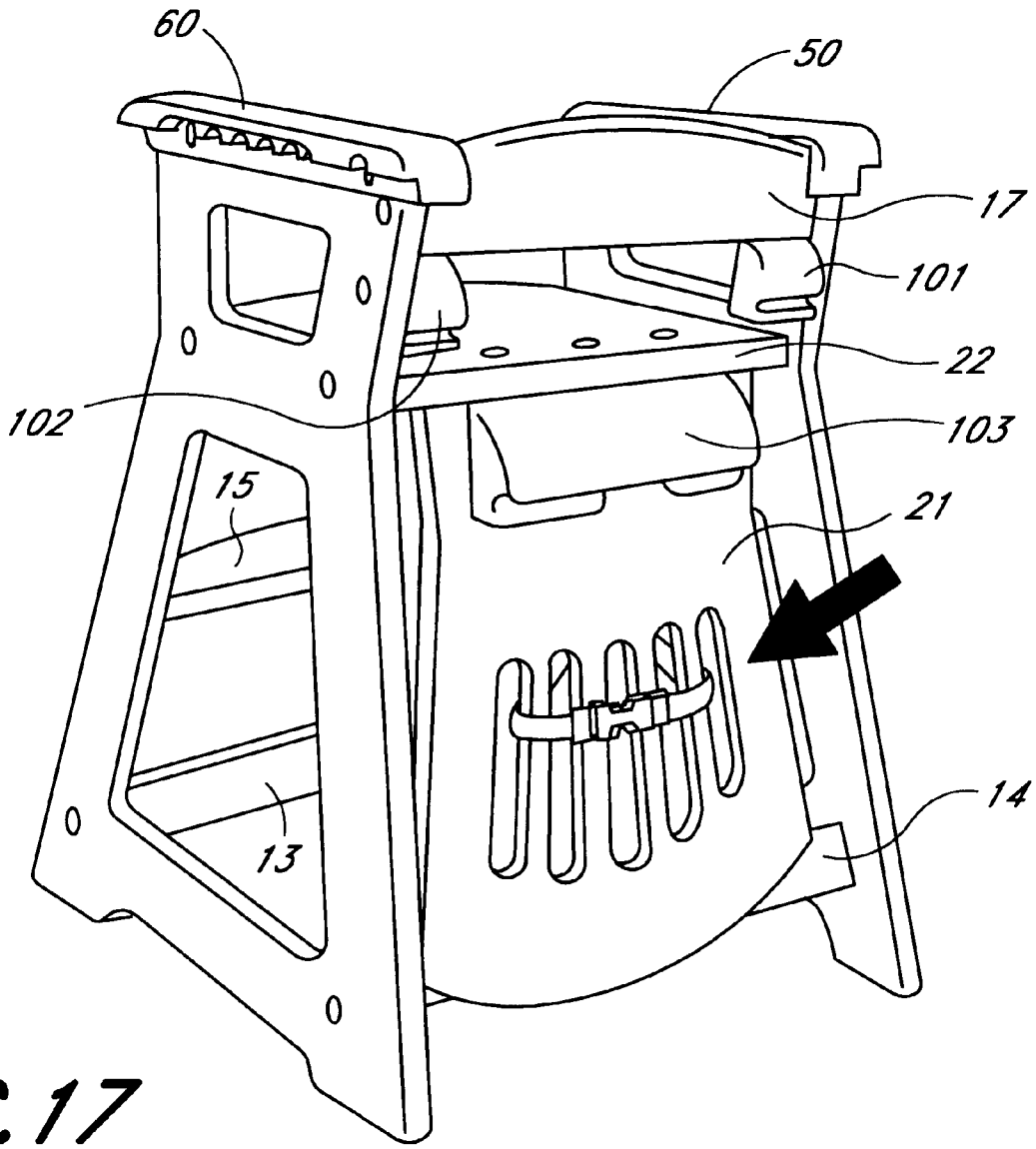
FIG. 17 is a perspective rear view of the invention in the youth mode.

Attached to the top of each of opposing side members 11, 12 is an arm rest 50, 60 each having a conventional tray attachment gripper mechanism 61 (FIG. 7) for facilitating attachment and removal of an auxiliary tray 70 (see FIGS. 11 and 15). Members 50, 60 are each provided with rearwardly located detent grooves 52 (FIGS. 7–9, 15 and 16) for providing a detent reference stop for seat 20 in the infant mode described below.

Seat 20 comprises a seat back portion 21 and a seat platform portion 22 secured to seat back 21 in any convenient fashion, such as doweling, wood fasteners or the like. In addition, seat back 21 and platform 22 are secured together at a comfortable angle.

Extending laterally from the sides of the forward edge of seat platform 22 is a pair of guide members 23, 24 each sized to be received in channels 31, 41 of guide members 30, 40, as well as into detents 52 formed in the rearward portion of arm rests 50, 60. Extending laterally of the edge portion of seat platform 22 adjacent the rear edge thereof is another pair of guide members 25, 26 dimensioned to be slidably engaged in channels 31, 41 of channel members 30, 40, and to be received in detents 32, 42 formed therein. The various modes of chair 10 will now be described.

Figure 9:
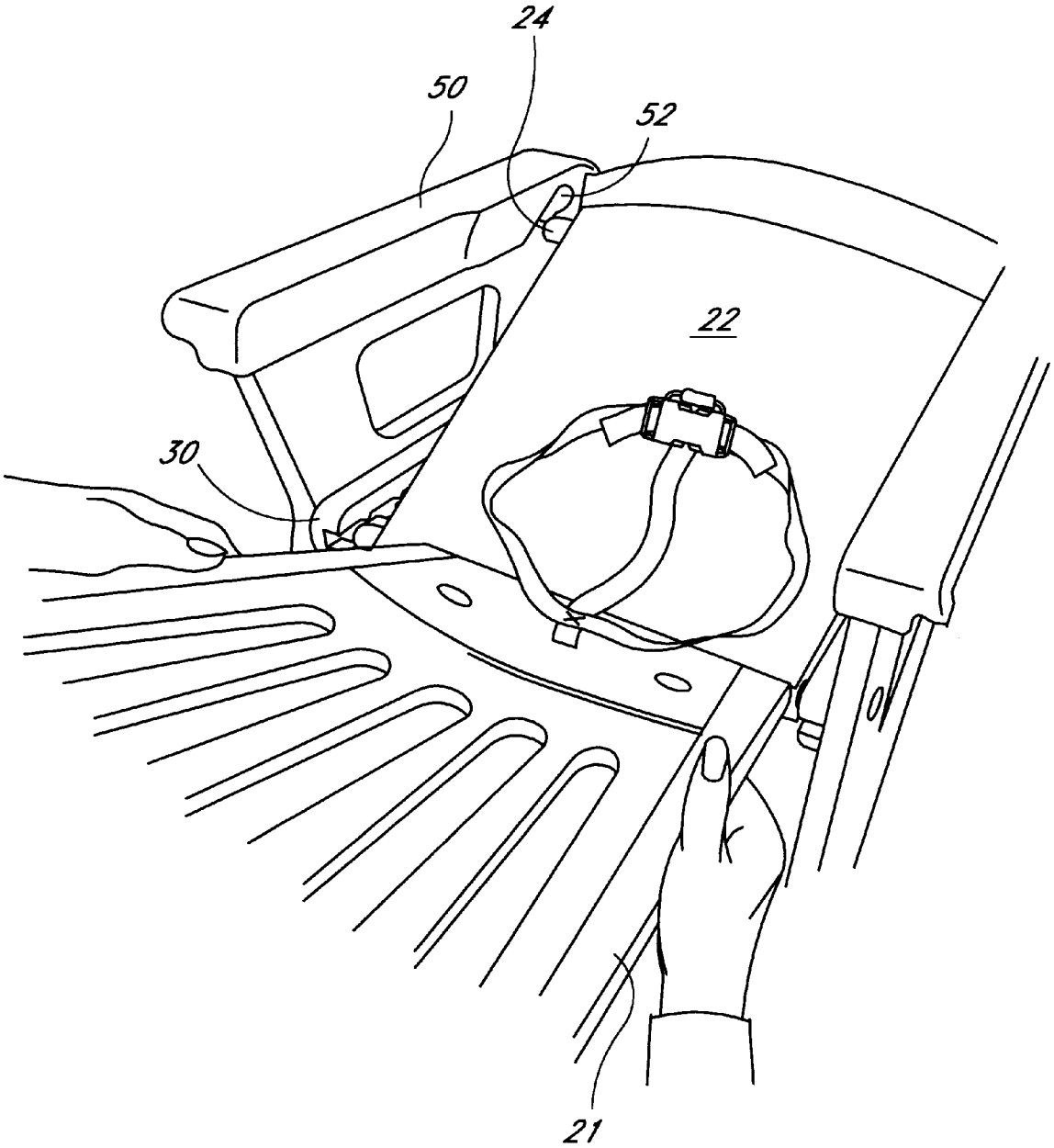
FIG. 9 is a view similar to FIG. 8 showing the scat just prior to full insertion for the infant mode.
Figure 14:
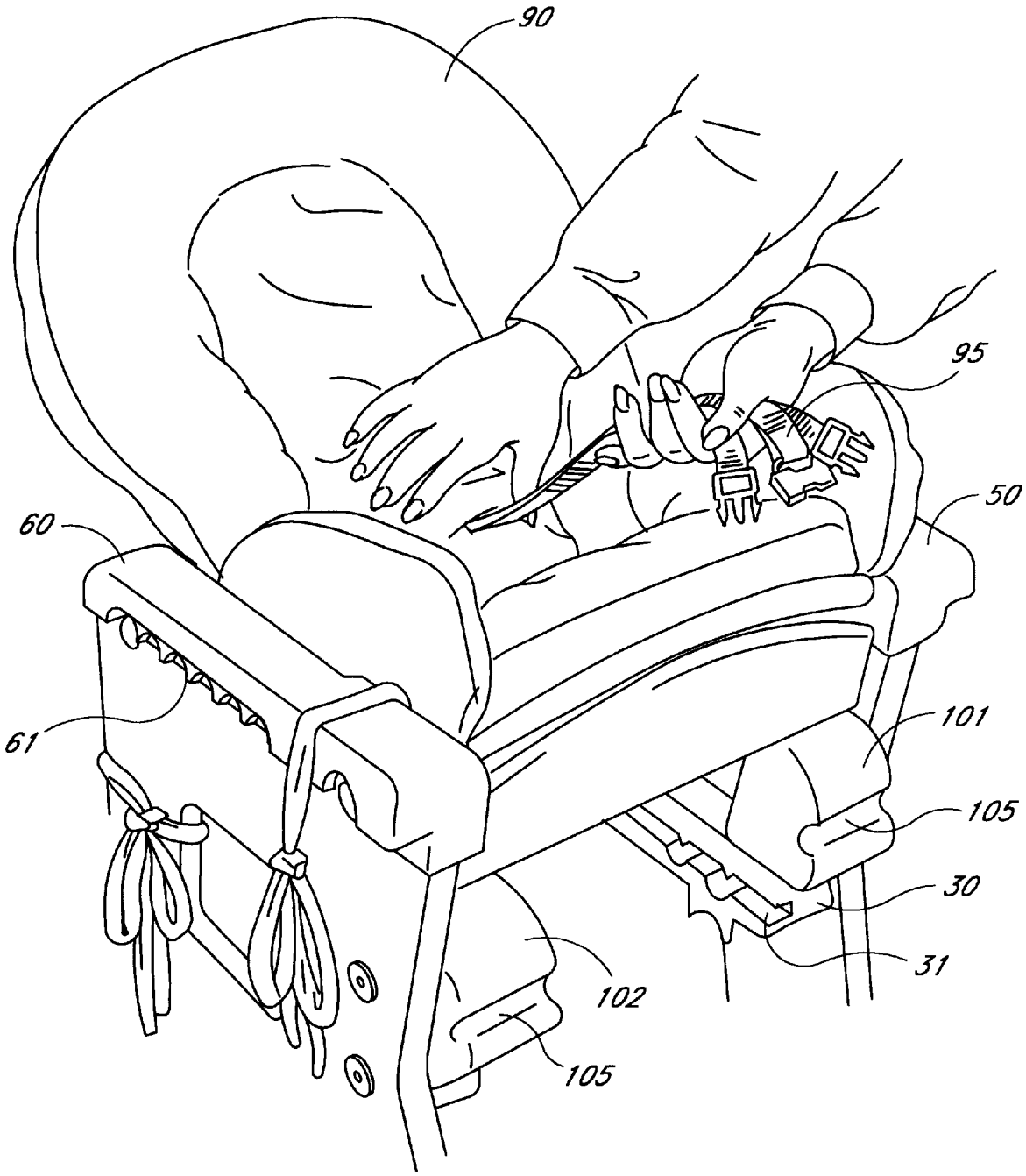
FIG. 14 is a view illustrating the use of a padded lining with the invention in the infant mode.

With reference to FIGS. 1, 2, and 7–9, in the infant mode, seat 20 is arranged at a canted angle with respect to a horizontal reference plane defined by guide channel members 30, 40 with seat back 21 extending outwardly and upwardly from the front of the chair 10. This is accomplished by installing guide members 25, 26 in channels 41, 31, respectively, from the front of chair base 10 (FIG. 8) with seat platform 22 angled upwardly and rearwardly, and sliding seat 20 rearwardly of base 10 until guide members 23, 24 are in position to be received in upper detents 52 formed in arm rests 50, 60 (FIG. 9). In this position, guide members 25, 26 will be received in one of the detent portions 32, 42 of each channel member 30, 40. With seat 20 installed in the infant mode, a padded lining can be removably supported by seat 20 in the manner depicted in FIGS. 10 and 14 for padded liner 90 and conventional harness belts 95 can be secured to seat 20 and used to hold an infant in the scat. Seat 20 can be removed from base 10 by essentially reversing the installation process, starting with lifting seat 20 until guide members 25, 26 are clear of detents 42, 32.

Figure 3:
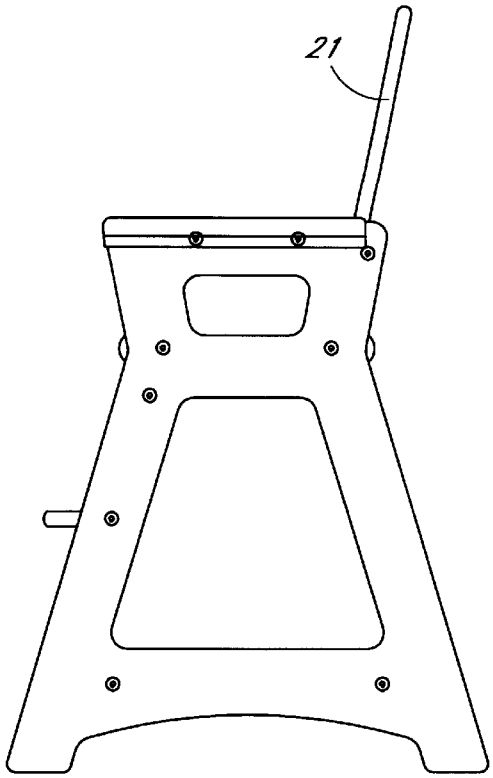
FIG. 3 is a side elevational view of the invention in the toddler mode.
Figure 4:
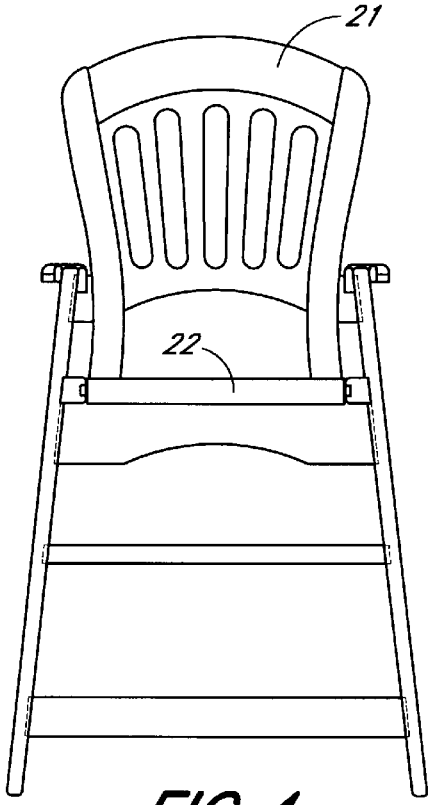
FIG. 4 is a front elevational view of the invention in the toodler mode.
Figure 5:
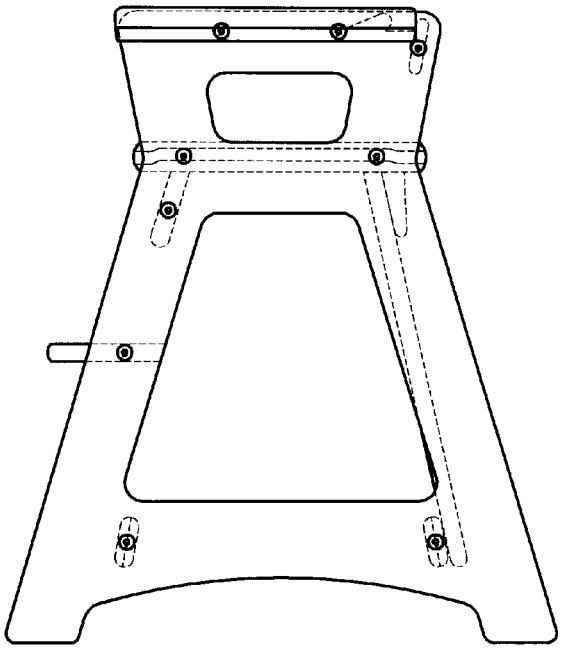
FIG. 5 is a side elevational view of the invention in the youth mode.
Figure 6:
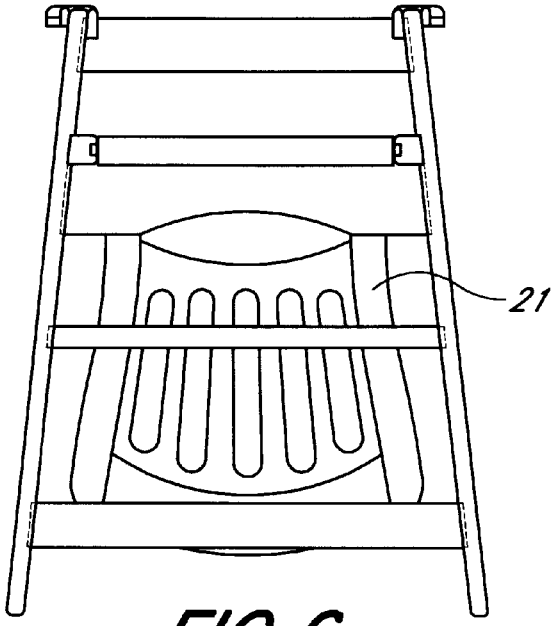
FIG. 6 is a front elevational view of the invention in the youth mode.

To configure the chair in the toddler mode, illustrated in FIGS. 3, 4 and 15, seat 20 is arranged with the seat back 21 upright and with seat 20 in a forward facing position. Next, guide members 25, 26 are inserted into channels 31, 41 of channel members 30, 40, respectively, from the front of chair base 10 and seat 20 is manipulated rearwardly of base 10. As guide members 23, 24 approach the forward edge of channel members 30, 40, the guide members 23, 24 are manipulated into channels 31, 41, respectively, and seat 20 is manipulated further in a rearward direction of base 10 until all guide members 23–26 are received in the appropriate detents 32, 42. In this configuration, belt harness 95 may be used to hold the toddler in the chair.

Figure 10:
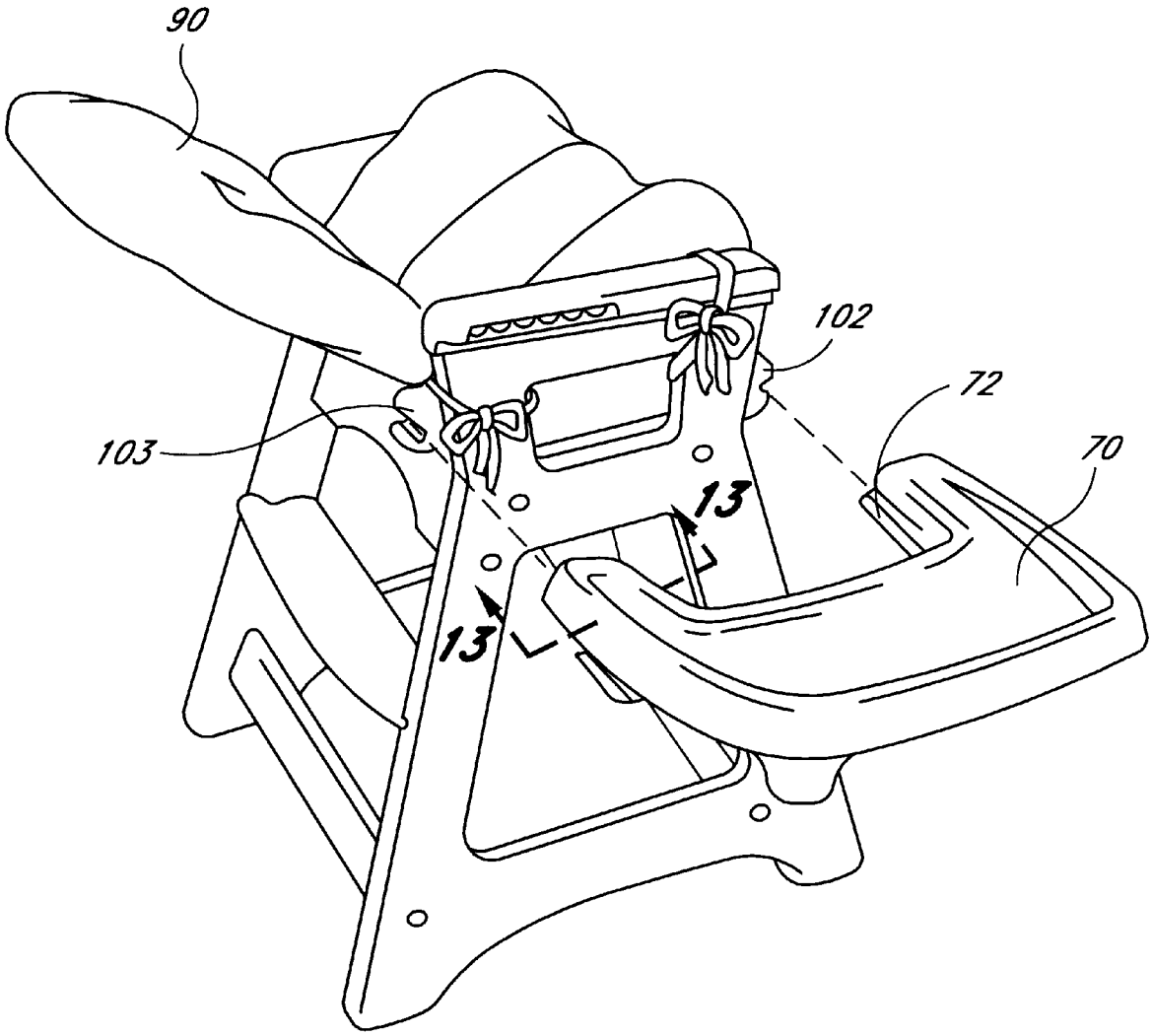
FIG. 10 is a perspective view illustrating manner of attachment of the removable tray from the side in the infant mode.
Figure 12:
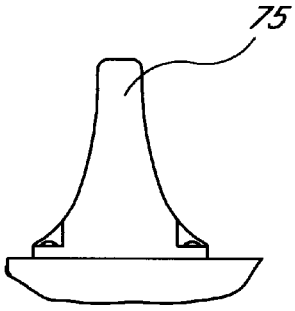
FIG. 12 is an elevational view of the passive restraint of the tray of FIG. 11.
Figure 13:
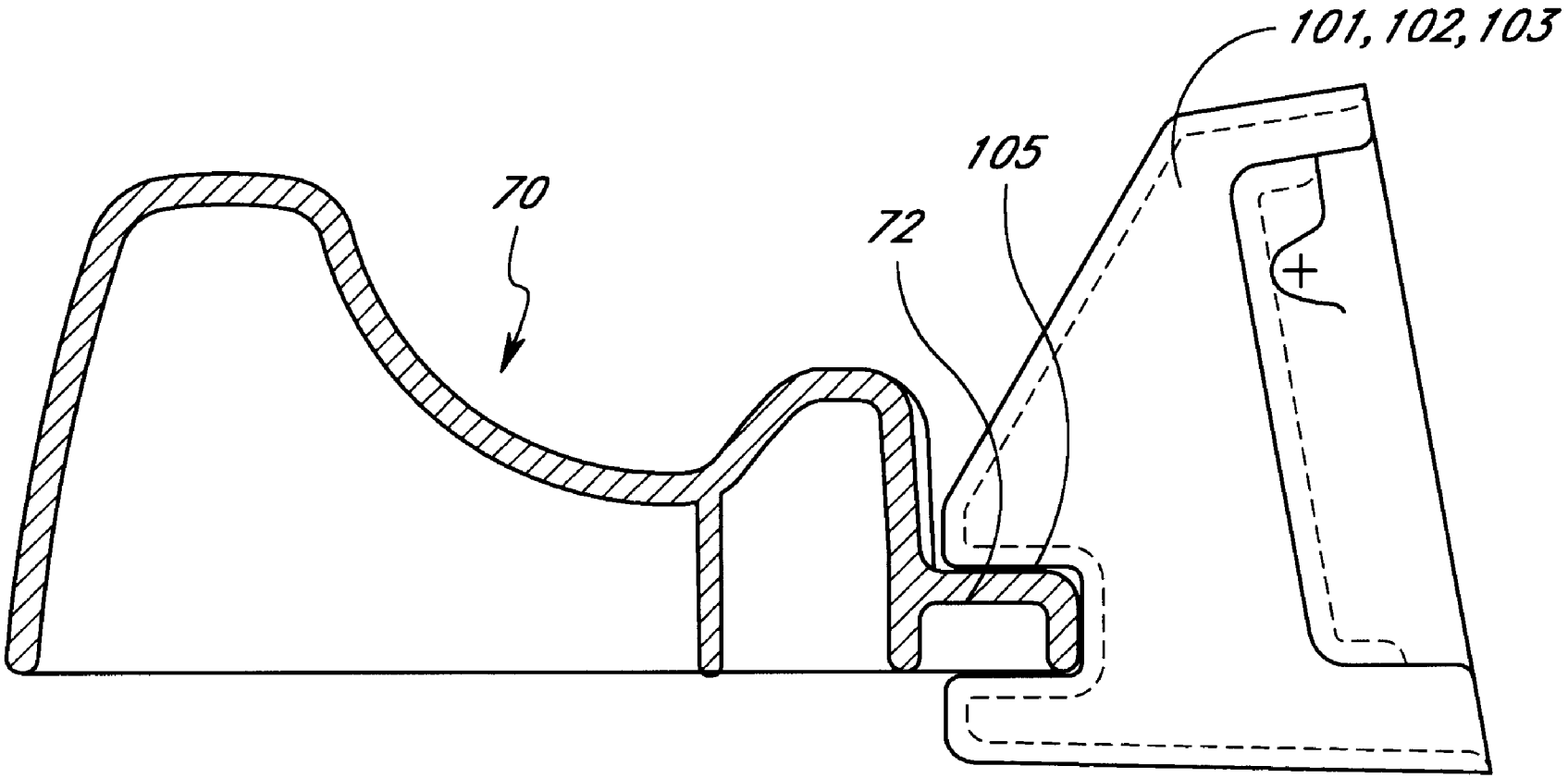
FIG. 13 is an enlarged sectional view taken along lines 13—13 of FIG. 10 illustrating the gripping engagement of the tray.

To configure the chair in the youth mode, illustrated in FIGS. 5, 6, 16 and 17, seat 20 is inverted at the rear of chair base 10, forward guide members 23, 24 are inserted into channels 41, 31, respectively, from the rear of base 10 and seat 20 is manipulated forwardly until rear seat guide members 25, 26 engage channels 41, 31, respectively. Thereafter, seat 20 is manipulated forwardly until guide members 23–26 are received in the appropriate detent positions. A particularly useful feature of the preferred embodiment is the provision of an auxiliary tray mounting mechanism for enabling the auxiliary tray 70 to be mounted from either side of the base in the infant mode. With reference to FIGS. 10 and 13, a pair of tray mounting channel members 101, 102 are secured at the rear of chair base 10 (see FIGS. 14 and 17). Each tray mounting member 101, 102 has a laterally extending channel 105 for gripping an inner edge portion 72 of auxiliary tray 70 (see FIG. 13). Secured to the rear of seat 20 is a tray mounting member 103 (see FIG. 17) having a pair of tray edge engaging channels 105 essentially identical to those provided in members 101, 102. When the chair is configured in the infant mode, tray 70 can be attached from either side of the chair base 10 by engaging inner shelf portions 72 of tray 70 with gripping channels 105 and sliding tray 70 inwardly or laterally of chair base 10. Thus configured, the infant's food can be rested on tray 70 and the supervising adult can be seated adjacent the chair or may stand, if desired. Tray 70 may also be installed from the front of the chair in a conventional manner as suggested in FIG. 15. When so installed, a passive restraint 75 formed on the underside of tray 70 (see FIGS. 11, 12 and 15) provide added safety to a child or toddler seated in the chair.

As will now be apparent, the invention affords a multimode chair which is relatively easy to configure in any one of the three modes and is extremely convenient to use. Further, no technical expertise or tools are required in order to reconfigure the chair between the three different modes. The invention thus affords wide flexibility and use and may be switched from one mode to another with very little effort.

While the above provides a full and complete disclosure of the preferred embodiments of the invention, various modifications, alternate constructions and equivalents will occur to those skilled in the art. Therefore, the above should not be construed as limiting the invention, which is defined by the appended claims.

What is claimed is:

1. A reconfigurable chair for infants, toddlers and small children, said chair comprising:

a chair base having a front, a back, and two opposing sides, said chair base providing a seat reference plane;

a removable seat having a back and a platform joined to said back; and a seat mounting arrangement that mounts said seat on said base at any one of three different attitudes:

a first attitude in which said seat is arranged at an angle with respect to said reference plane, in which said seat platform is angled upwardly with respect to said reference plane;

a second attitude in which said seat platform is essentially parallel to said reference plane with said seat back extending generally upwardly from said reference plane; and a third attitude in which said seat platform is essentially parallel to said reference plane with said seat back extending generally downwardly from said reference plane.

2. The combination of claim 1 wherein said seat mounting arrangement includes a pair of channels formed in said chair base and extending from front to back.

3. The combination of claim 2 wherein at least one of said channels includes a position detent for removably retaining said seat in said chair base.

4. The combination of claim 2 wherein said seat mounting arrangement enabling means further includes a pair of detent members positioned adjacent the back of said chair base at a level above said pair of channels.

5. The combination of claim 1 wherein said seat mounting arrangement includes a first pair of guide members carried by said seat adjacent the junction of said back and said platform and extending laterally outwardly therefrom.

6. The combination of claim 5 wherein said platform has a free end; and wherein said seat mounting arrangement further includes a second pair of guide members 23, 24 carried by said platform of said seat adjacent the free end thereof and extending laterally outwardly therefrom.

7. The combination of claim 1 wherein said chair further includes a tray mount for enabling an auxiliary tray to be removably secured laterally thereto.

8. The combination of claim 7 wherein said tray mount includes a first channel member secured to said chair base adjacent said back and a second channel member secured to said seat adjacent the junction of said back with said platform.

9. The combination of claim 7 wherein said scat has two opposing sides; and wherein said tray mount includes a first pair of channel members secured to said chair base adjacent said back, each of said first pair of channel members being located adjacent a different one of said two opposing sides of said base; and a second pair of channel members secured to said seat adjacent the junction of said back with said platform, each of said second pair of channel members being located adjacent a different one of said two opposing sides of said seat.

10. The combination of claim 7 further including a tray removably secured to said chair.

11. A reconfigurable chair for infants, toddlers and small children, said chair comprising:

a chair base having a front, a back, and opposing sides, said base including a pair of side members and a plurality of cross members for securing said side members together, each of said pair of side members having an inner surface portion, said chair base providing a reference plane;

a removable seat having a back and a platform joined to said back, said platform having a free end; and a seat mounting arrangement extending along the inner surface portion of each of said pair of side members for enabling said seat to be mounted on said base at any one of three different attitudes:

a first attitude in which said seat is arranged at an angle with respect to said reference plane, in which said seat platform is angled generally upwardly from said reference plane;

a second attitude in which said seat platform is essentially parallel to said reference plane with said seat back extending generally upwardly from said reference plane; and a third attitude in which said seat platform is essentially parallel to said reference plane with said seat back extending generally downwardly from said reference plane.

12. The combination of claim 11 wherein said seat mounting arrangement comprises a pair of channels each extending between the front and the back along the inner surface portion of a different one of said pair of side members, and a pair of guide members carried by said seat adjacent the junction of said seat and said platform and extending laterally outwardly therefrom, said pair of guide members being slidably receivable in said channels.

13. The combination of claim 12 wherein at least one of said pair of channels includes a detent portion for removably retaining a corresponding one of said pair of guide members received therein.

14. The combination of claim 12 wherein said seat mounting arrangement further includes a pair of detent members positioned adjacent the back of said chair base at a level above said pair of channels; and a second pair of guide members carried by said platform of said seat adjacent the free end thereof and extending laterally outwardly therefrom.

15. The combination of claim 11 further including a tray mount for enabling an auxiliary tray to be removably secured laterally thereto.

16. The combination of claim 15 wherein said tray mount includes a first channel member secured to said chair base adjacent said back and a second channel member secured to said seat adjacent the junction of said back with said platform.

17. The combination of claim 15 wherein said seat has two opposing sides; and wherein said tray mount includes a first pair of channel members secured to said chair base adjacent said back, each of said first pair of channel members being located adjacent a different one of said two opposing sides of said base; and a second pair of channel members secured to said seat adjacent the junction of said back with said platform, each of said second pair of channel members being located adjacent a different one of said two opposing sides of said seat.

18. The combination of claim 15 further including a tray removably secured to said chair.

19. The combination of claim 11 wherein said back and said platform are joined at an angle greater than 90 degrees.

20. The combination of claim 11 wherein said chair further includes tray mount for enabling an auxiliary tray to be removably secured thereto from the front of said chair base.

21. A reconfigurable chair for infants, toddlers and small children, said chair comprising:

a chair base having a front, a back, and two opposing sides, said chair base providing a seat reference plane;

a removable seat having a back and a platform joined to said back; and a seat mounting arrangement that mounts said seat on said base at any one of three different attitudes:

a first attitude in which said seat is angled with respect to said reference plane;

a second attitude in which said seat platform is essentially parallel to said reference plane with said seat back extending generally upwardly from said reference plane; and a third attitude in which said seat platform is essentially parallel to said reference plane with said seat back extending generally downwardly from said reference plane;

wherein said base remains at a same orientation relative to a ground surface in each of said three different attitudes.

* * * * *